United States Patent [19]

Brantner

[11] 4,035,952

[45] July 19, 1977

[54] LOUVERED WINDOW LOCK

[76] Inventor: Bernard H. Brantner, 14255 Tyler St., Sylmar, Calif. 91342

[21] Appl. No.: 716,544

[22] Filed: Aug. 23, 1976

[51] Int. Cl.[2] ..... E06B 7/086

[52] U.S. Cl. ..... 49/74; 292/300; 292/345

[58] Field of Search ..... 49/51, 55, 87, 90, 88, 49/50, 74, 394, 395, 371, 64; 292/345, 259, 288, 258, 300

[56] References Cited

U.S. PATENT DOCUMENTS

| | | | |
|---|---|---|---|
| 1,050,010 | 1/1913 | Donnell | 49/90 |
| 2,726,426 | 12/1955 | Biggs | 49/371 |
| 3,981,525 | 9/1976 | Mayes | 292/59 R |

*Primary Examiner*—Philip C. Kannan
*Attorney, Agent, or Firm*—Robert E. Geauque

[57] ABSTRACT

A louvered window lock which comprises an elongated bar having a plurality of spaced apart brackets thereon. Each bracket is to be in contact with the upper edge of a glass panel of a louvered window with at least one of the brackets having a forward overhanging lip to be in contact with the outside surface of its respective glass panel. The lower end of the bar is fixedly secured to the lower windowsill with the upper end of the bar to be located flush against the upper windowsill.

5 Claims, 3 Drawing Figures

LOUVERED WINDOW LOCK

BACKGROUND OF THE INVENTION

The field of this invention relates to a window lock and more particularly to a lock for a louvered window.

A common type of window what is called a louvered window. This window is comprised of a plurality of glass panels which, when the window is in the closed position, the panels slightly overlap each other. Each of the panels is pivotally connected to a linkage mechanism and this linkage mechanism can be activated from the inside surface of the window to cause pivoting of the glass panels to form spaces between the panels. When the glass panels are in this position, the window is in the open position.

One problem with this type of window is that with the right type of tool a person can gain unauthorized access into a house or building which has this type of window by removing one or more of the panels from the outside of the window. Each of the glass panels are supported in brackets at the bottom edge thereof and the glass panels can be raised upwardly out of the mounting brackets and when enough of the panels are removed, a person can gain access into the interior of the premises.

Previous to this invention, there is no known satisfactory lock for louvered windows which absolutely prevent unauthorized access through a louvered window with the lock in position.

SUMMARY OF THE INVENTION

The subject matter of this invention is believed to be summarily described in the Abstract Of The Disclosure and reference is to be had thereto.

The primary objective of this invention is to employ an easy and simple lock for a louvered window which, when installed in position, for all practical purposes makes it impossible for a person to gain unauthorized access through the window from the outside of the window.

Another feature of this invention is that the subject structure is composed of few parts and can be manufactured at a low manufacturing cost and therefore, can be sold at a low retail sales price.

DETAILED DESCRIPTION OF THE SHOWN EMBODIMENT

Figure 1:
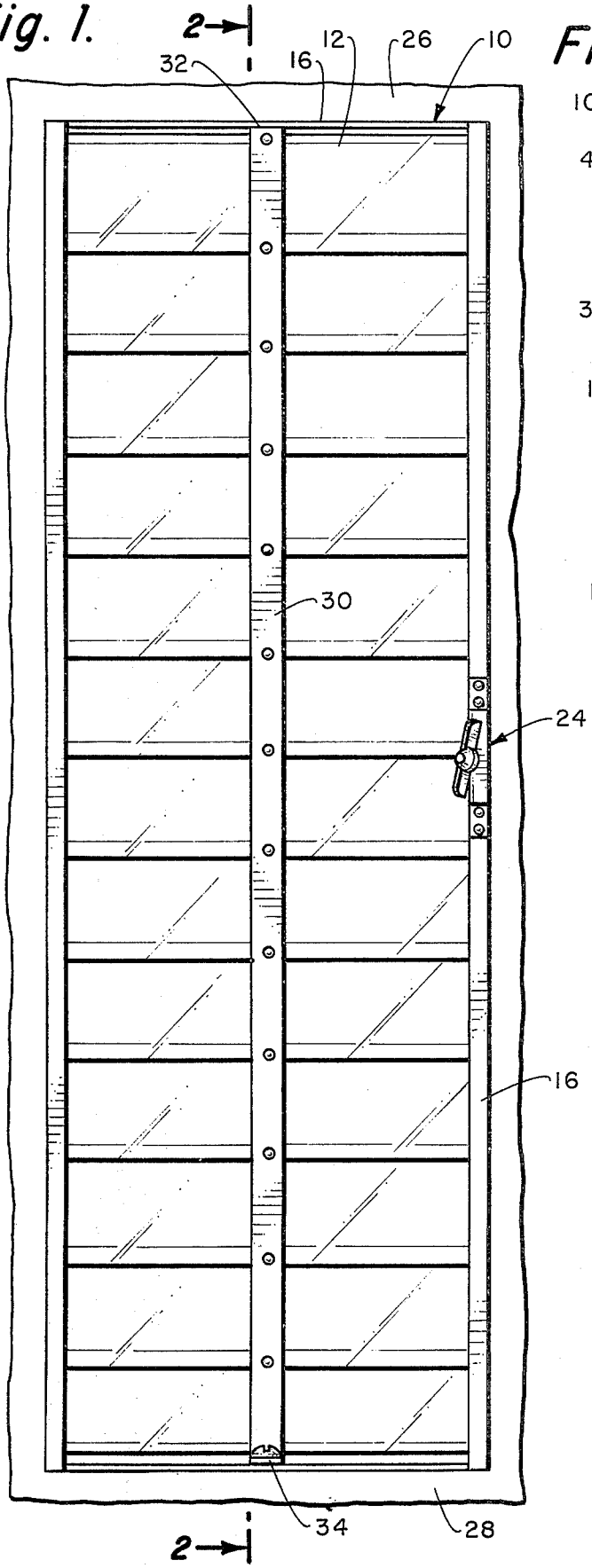
FIG. 1 is a view of a louvered window assembly upon which has been mounted the locking device of this invention.

Referring particularly to the drawing, there is shown in FIG. 1 a conventional louvered window assembly 10. The louvered window assembly 10 constitutes a plurality of glass panels 12 each of which are fixed to a bracket 14. The brackets 14 are pivotally mounted to the frame 16 of the window by means of a pivot pin 18. Each of the brackets 14 are pivotally attached to a bar 20. The bar 20 is to be movable by means of actuation assembly 24 which operates through a linkage assembly 22. By operation of the actuation assembly 24, the bar 20 is moved, which, in turn, results in pivoting of the glass panels 12 from the closed position shown in FIG. 2 to an open position (not shown) where the glass panels would have air spaces therebetween. The completely open position is when the panels 20 are substantially horizontal and when in the closed position, the panels 12 are substantially vertical. It is to be noted that each of the panels 12 slightly overlap each other. The frame 16 is fixedly secured between the upper sill 26 and the lower sill 28.

The locking device of this invention constitutes an elongated bar 30 which has an upper end 32 and a lower end in the form of a right angled shaped foot 34. Within the foot 34 is located an opening 36.

Figure 2:
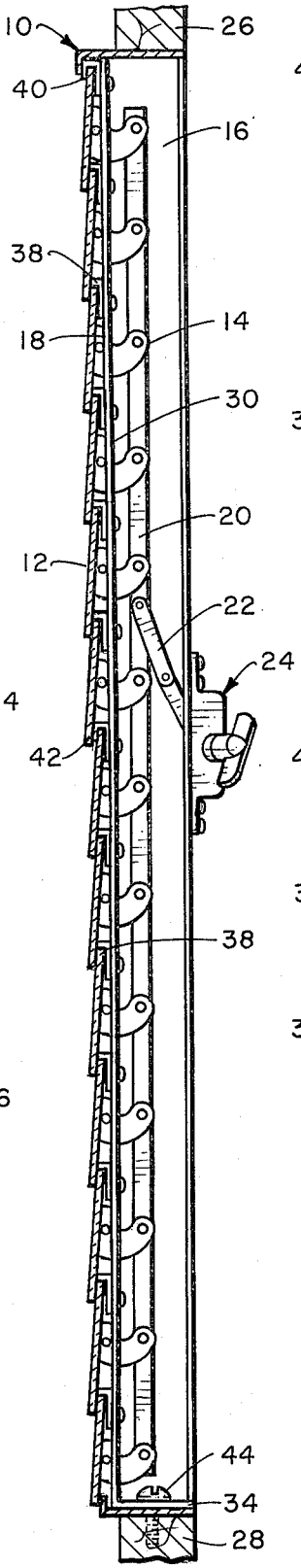
FIG. 2 is a cross-sectional view taken along line 2—2 of FIG. 1.
Figure 3:
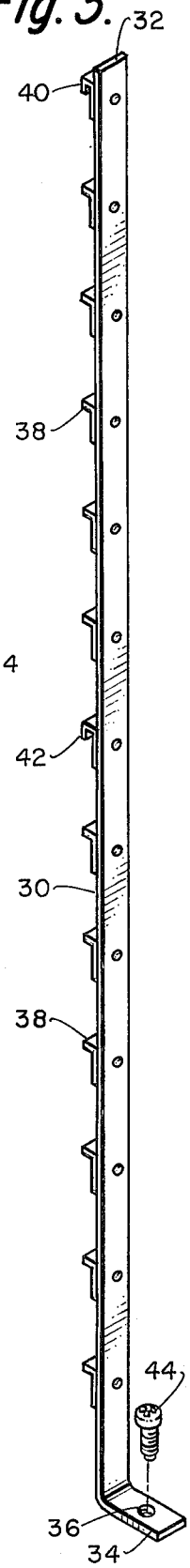
FIG. 3 is an isometric view of the locking device of this invention separate from the window.

Fixedly secured on the outside surface of the bar 30 are a plurality of brackets 38. The spacing between the brackets 38 is equal to the spacing between the top edges between adjacent glass panels 12 with the window in the closed position as shown in FIG. 2. The bracket 38 that is located directly adjacent the upper end 32 includes a forward depending lip 40. The bracket located substantially in the center of the longitudinal length of the bar 30 also includes a depending lip 42.

With the window in the closed position, the member 30 is connected to the glass panel so that the lip 40 extends over the upper edge of the uppermost glass panel 12 (as shown in FIG. 2). Also, the lip 42 extends over the upper edge of its particular glass panel. The remaining brackets 38 merely rest against the upper edge of their respective glass panel 12. A threaded fastener 44 is passed through the opening 36 and extends to within the lower sill 28. The upper end 32 rests flush against the portion of the window frame located upon the upper sill 26.

In this position, any person from the outside of the window trying to remove one of the glass panels and in order to do so must move the glass panel upwardly. This upward movement is prevented because the upper edge of the glass panel rests against a bracket 38. Therefore, unless the person chooses to break the panels, there is no known way to gain unauthorized access through the window by removing the glass panels 12.

With the device installed, as shown in FIG. 2, the window can be opened. During the opening movement, the upper edges of each of the glass panels merely moves out of contact with its respective bracket 38. When the window is again closed, the upper edge of each of the glass panels then moves into contact with its respective bracket 38. If desirable, the upper end 32 may be fixedly secured to the upper sill 26. In this event, the window could not even then be opened from the inside. In some instances, it may be desirable to prevent the window from opening.

What is claimed is:

1. In combination with a louvered window which consists of a plurality of overlapping glass panels, said glass panels being pivotally connected to an actuation mechanism, said actuation mechanism being manually operable to cause pivoting of said glass panels between a closed position and an open position with spaces being formed between adjacent glass panels, said louvered window having an outside surface and an inside surface, said actuation mechanism being only actuatable at said inside surface, said louvered window being mounted between an upper windowsill and a lower windowsill, a louvered window lock comprising:

an elongated bar having an upper end and a lower end, said upper end of said bar to be located directly adjacent said upper windowsill, said lower end of said bar to be located directly adjacent said lower windowsill attaching means to secure said lower end of said bar to said lower windowsill;

a plurality of brackets secured to said bar with said brackets being spaced apart, each said bracket to be in contact with the upper edge of a said glass panel with there being a separate bracket for each said glass panel, whereby with said bar secured in place upon said lower windowsill and each bracket being in contact with the upper edge of a said glass panel that it is not possible for one to remove intact any one of the glass panels.

2. The combination as defined in claim 1 wherein:

said attaching means comprises a threaded fastener which penetrates into said lower window sill.

3. The combination as defined in claim 1 including:

at least one of said brackets including a forward depending lip, said forward depending lip to be in contact with the outside surface of its respective said glass panel.

4. The combination as defined in claim 3 wherein:

the bracket nearest said upper end of said bar having said forward depending lip.

5. The combination as defined in claim 4 wherein:

there being a second said bracket having a said forward depending lip, said second said bracket being located approximately at the mid point of the longitudinal length of said bar.

* * * * *